US005367748A

United States Patent [19]

Leifeld et al.

[11] Patent Number: 5,367,748

[45] Date of Patent: Nov. 29, 1994

[54] LOCATION DETERMINING DEVICE FOR A TRAVELLING BALE OPENER

[75] Inventors: Ferdinand Leifeld, Kempen; Josef Temburg, Jüchen, both of Germany

[73] Assignee: Trützschler GmbH & Co. KG, Monchengladbach, Germany

[21] Appl. No.: 145,618

[22] Filed: Nov. 4, 1993

Related U.S. Application Data

[62] Division of Ser. No. 899,844, Jun. 17, 1992, Pat. No. 5,285,552.

[30] Foreign Application Priority Data

Jun. 17, 1991 [DE] Germany ..... 4119888

[51] Int. Cl.[5] ..... D01G 7/04

[52] U.S. Cl. ..... 19/80 R; 377/24.1; 33/710

[58] Field of Search ..... 19/80 R; 340/671, 672, 340/679; 324/226; 377/24.1; 33/710

[56] References Cited

U.S. PATENT DOCUMENTS

| | | | |
|---|---|---|---|
| 2,584,963 | 2/1952 | Hoelscher | 33/710 X |
| 2,846,769 | 8/1958 | Colont | 33/710 |
| 2,862,410 | 12/1958 | Meyer | 33/710 X |
| 3,750,128 | 7/1973 | Sapir | 340/671 X |
| 4,035,790 | 7/1977 | Farmer | 340/671 |
| 4,257,040 | 3/1981 | Shirasaki | 340/671 |
| 5,121,418 | 6/1992 | Staheli et al. | 377/24.1 |

FOREIGN PATENT DOCUMENTS

| | | |
|---|---|---|
| 2832085 | 11/1980 | Germany . |
| 3730487 | 3/1989 | Germany . |
| 8713492 | 3/1989 | Germany . |
| 3912737 | 10/1990 | Germany . |
| 3928835 | 7/1991 | Germany . |
| 3936810 | 8/1991 | Germany . |
| 652422 | 11/1985 | Switzerland . |
| 1021535 | 3/1966 | United Kingdom . |
| 1370703 | 10/1974 | United Kingdom . |
| 1543055 | 3/1979 | United Kingdom . |
| 1583378 | 1/1981 | United Kingdom . |
| 1553-574 | 6/1988 | U.S.S.R. . |

*Primary Examiner*—Clifford D. Crowder
*Assistant Examiner*—John J. Calvert
*Attorney, Agent, or Firm*—Spencer, Frank & Schneider

[57] ABSTRACT

A bale opener for removing fiber tufts from top surfaces of fiber bales assembled in a series includes a carriage for travelling back-and-forth along a generally horizontal, first path of travel along the fiber bale series; a tower mounted on the carriage for travel therewith; a fiber tuft detaching device extending from the tower and movable relative to the tower along a generally vertical, second path of travel; and an incremental rotary displacement signalling device including a shaft; a toothed rotary element mounted on the shaft; a counter element meshing with the rotary element which is movable relative to the counter element; and a signal generator coupled to the toothed element for generating signals as a function of rotary displacements of the toothed element. One of the elements is mounted on the detaching device (or other co-travelling component) and the other element is mounted along one of the first and second paths of travel for generating signals as a function of displacement of the detaching device along at least one of the first and second paths of travel.

5 Claims, 5 Drawing Sheets

LOCATION DETERMINING DEVICE FOR A TRAVELLING BALE OPENER

This is a Division of application Ser. No. 07/899,844 filed Jun. 17, 1992, now U.S. Pat. No. 5,285,552.

CROSS REFERENCE TO RELATED APPLICATION

This application claims the priority of German Application No. P 41 19 888.3 filed Jun. 17, 1991, which is incorporated herein by reference.

BACKGROUND OF THE INVENTION

The invention relates to a bale opener for removing fiber tufts from fiber bales such as cotton bales or chemical fiber bales, by means of a detaching device comprising, for example, a rapidly rotating detaching (opening) roll. The detaching device is accommodated in a downwardly open housing which is mounted in a cantilever fashion on a bale opener tower which itself is mounted on a carriage travelling back and forth along fiber bales arranged in a series. The cantilevered detaching device may be vertically moved relative to the tower by means of a lifting motor or the like.

In a known apparatus a friction wheel is secured to the carriage and the friction wheel rolls on a stationarily fixed, horizontally oriented fiber tuft suction channel. A counting disc with slit openings is coaxially mounted on the shaft of the friction wheel and two stationary inductive sensors are associated with the zone where the slit openings are provided for sensing the number of revolutions of the friction wheel. An evaluating device which processes the pulses emitted by the sensor, determines the location of the bale opener along its travel path. A positive connection between the friction wheel and the upper face of the channel is, among others, dependent from the pressing force and the coefficient of friction. In case the upper face (frictional contact surface) of the channel is exposed to slippery material such as brake fluid or the pressing force is varied, slippage of the friction wheel relative to the frictional surface may occur. Such an occurrence would result in a faulty indication of the actual position of the bale opener along its travelling path. It is a further disadvantage of known constructions of the above-outlined type that the cooperation between the sensors and the counting disc may be adversely affected. In particular, the setting between sensors and the counting disc may be mechanically disturbed.

SUMMARY OF THE INVENTION

It is an object of the invention to provide an apparatus of the above-outlined type from which the discussed disadvantages are eliminated and which, in particular, makes possible an accurate determination of the longitudinal location of the bale opener tower and/or the vertical location of the detaching device relative to the tower and eliminates interfering effects on the rotary path determining device.

This object and others to become apparent as the specification progresses, are accomplished by the invention, according to which, briefly stated, the bale opener for removing fiber tufts from top surfaces of fiber bales assembled in a series includes a carriage for travelling back-and-forth along a generally horizontal, first path of travel along the fiber bale series; a tower mounted on the carriage for travel therewith; a fiber tuft detaching device extending from the tower and movable relative to the tower along a generally vertical, second path of travel; and an incremental rotary displacement signalling device including a shaft; a toothed rotary element mounted on the shaft; a counter element meshing with the rotary element which is movable relative to the counter element; and a signal generator coupled to the toothed element for generating signals as a function of rotary displacements of the toothed element. One of the elements is mounted on the detaching device (or other co-travelling component) and the other element is mounted along one of the first and second paths of travel for generating signals as a function of displacement of the detaching device along at least one of the first and second paths of travel.

By virtue of the form-locking arrangement between the rotary tooth element (and thus the shaft of the displacement signalling device) and the toothed counter element (toothed rack), a positive, slippage-free engagement is obtained so that the rotary motion of the tooth element reflects in a precise manner the change of the location of the carriage in the longitudinal direction and/or the detaching device in the vertical direction.

The apparatus according to the invention further has the following additional advantageous features:

- The rotary path sensor is a magnetic incremental rotary transmitter.
- The rotary path sensor determines the number of revolutions or the extent of angular displacement of the tooth elements or the shaft thereof.
- The path sensor is an encapsulated path sensor and the shaft of the tooth element penetrates through the housing capsule.
- The shaft of the toothed element is sealed against the housing wall.
- The rotary toothed element is a gear, a chain or a tooth belt sprocket or the like and the toothed counter element is a toothed rack, a toothed belt, a chain or the like.
- The path sensor is mounted on the carriage (for example, the carriage chassis) and the toothed counter element is mounted on the stationary fiber tuft suction channel.
- The rotary toothed element may change its position relative to the stationary toothed counter element.
- The rotary toothed element rolls on the stationary toothed counter element.
- The toothed counter element may change its position relative to the stationary rotary toothed element.
- The rotary path sensor is associated with a wheel of the carriage or the drive motor thereof.
- The rotary toothed element is associated with the cantilevered detaching device and the toothed counter element is associated with bale opener tower.
- The toothed element is a stationary end roll for an endless, circulating counter element, for example, a toothed belt or chain or the like.
- The detaching device may be oriented in an inclination such that the detaching operation is performed on the fiber bales along a plane which is obliquely oriented to the horizontal. Further, the vertical displacement (feed) of the detaching device, effected by a lifting motor, and the horizontal travel of the carriage, effected by a propelling motor, are coordinated by a control device as a function of the angle of inclination of the detaching device to the horizontal.

DESCRIPTION OF THE PREFERRED EMBODIMENTS

Figure 1A:
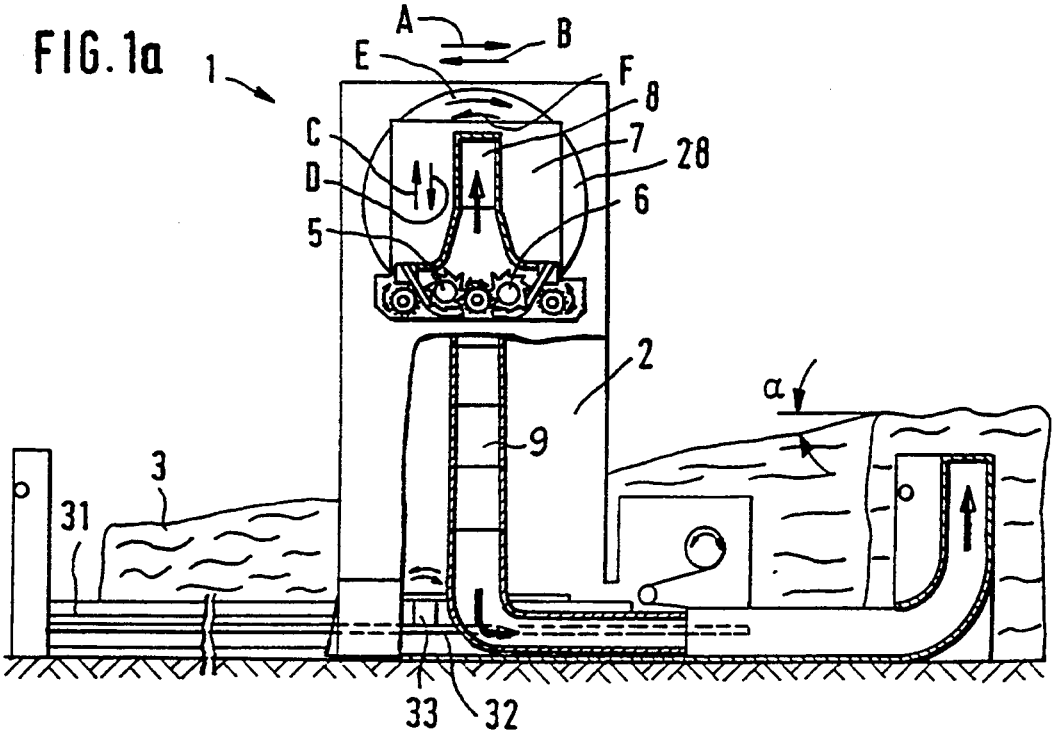
FIG. 1*a* is a schematic, partially sectional side elevational view of a bale opener incorporating the invention.
Figure 3:
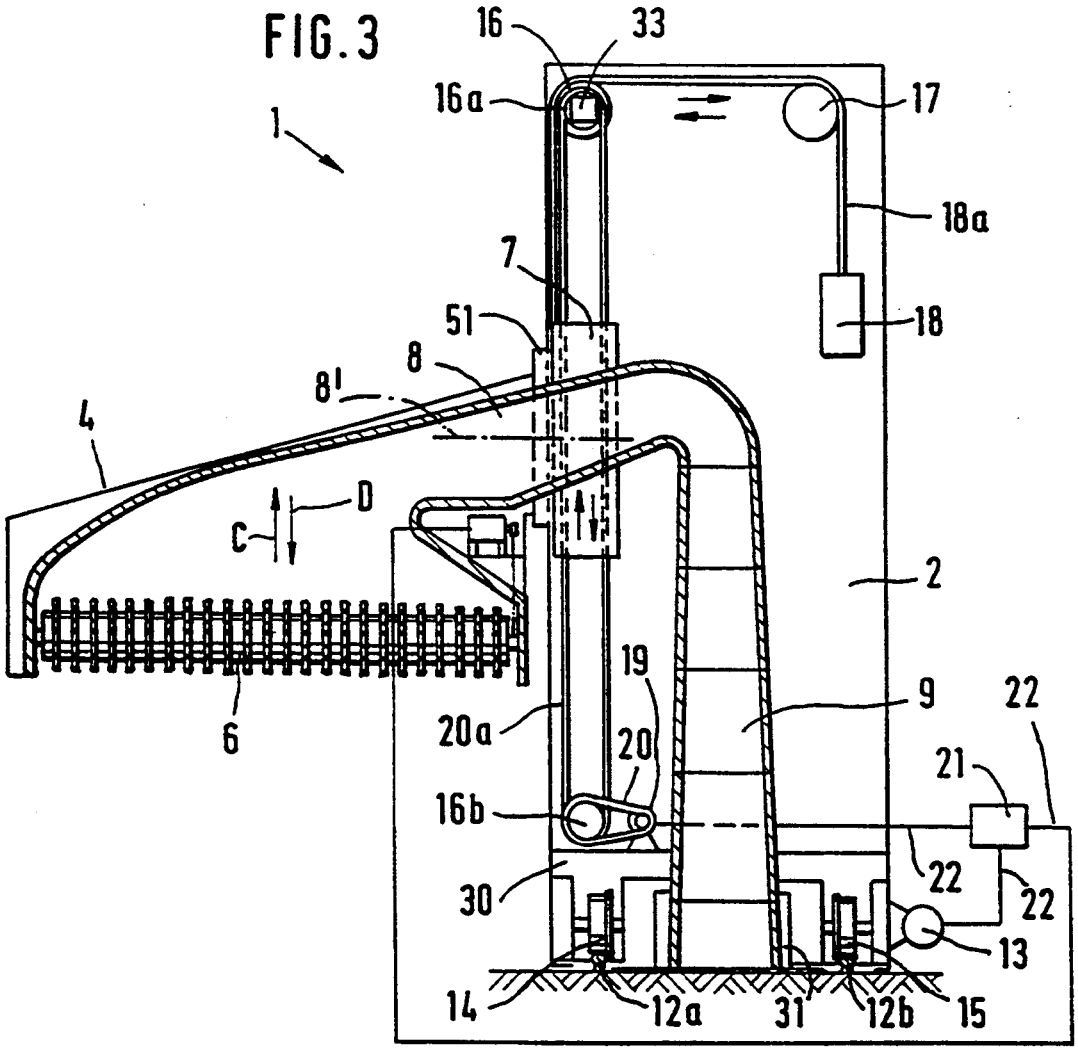
FIG. 3 is a schematic, partially sectional end elevational view of a bale opener incorporating still another preferred embodiment of the invention.

Turning to FIGS. 1*a* and 3, there is illustrated therein a bale opener generally designated at 1 which may be a BLENDOMAT BDT 020 model, manufactured by Trützschler GmbH & Co. KG, Mönchengladbach, Germany. The bale opener 1 has a tower 2 which travels in the direction designated by arrows A and B back and forth parallel to a fiber bale series 3. A detaching device 4 projects from one side of the bale opener tower 2 and is secured thereto in cantilever fashion. The detaching device 4 has two oppositely rotating, parallel-oriented opening rolls 5 and 6. The detaching device 4 is supported on the tower 2 by means of a holding device 7. The fiber tufts detached from the fiber bales by the opening rolls 5 and 6 during the travel of the bale opener 1 in the directions A and B are carried away through a duct entrance 8 situated above the opening rolls 5 and 6 and a suction duct 9 extending downwardly through the bale opener tower 2. The suction duct 9 merges into a suction channel 31 which is secured to the ground between bale opener rails 12*a*, 12*b*.

The detaching device 4 is mounted on the tower 2 for vertical displacement relative to the tower 2, as indicated by the arrows C and D. Further, the detaching device 4 is mounted on the holding device 7 by a toothed ring gear 51 and is thus as a whole supported for rotation relative to the holding device 7 about a horizontal central axis 8' of the detaching device 4 as indicated by the curved arrows E and F. By virtue of such a rotation of the detaching device 4, the latter may be brought to a predetermined inclined position relative to the bale series 3 so that the fiber tufts may be detached from the top surfaces of the fiber bales along a face of predetermined inclination. It will be understood, however, that the fiber tuft detaching plane may be horizontal, for which case the detaching device 4 assumes a zero angle to the horizontal.

By virtue of the angular (rotational) adjustability of the detaching device 4, the detaching operation may be performed continuously since periodically new fiber bales may be added to the fiber bale series at that end thereof where the inclined bale detaching surface is the highest. The fiber bale series 3 is supported on conveyor belts which feed the bale series 3 towards the bale opener.

Figure 1D:
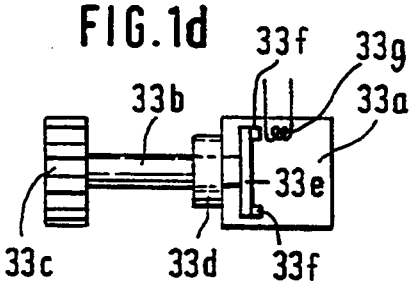
FIG. 1*d* is an end elevational view, on an enlarged scale, of several components of the structure shown in FIG. 1*b*.
Figure 1C:
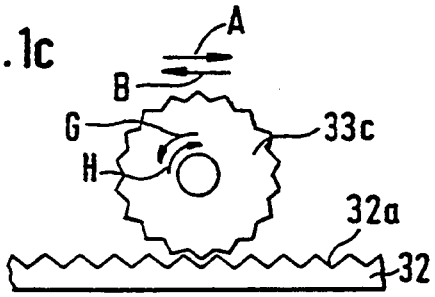
FIG. 1*c* is a schematic top plan view of some components of the structure shown in FIG. 1*b*.
Figure 1B:
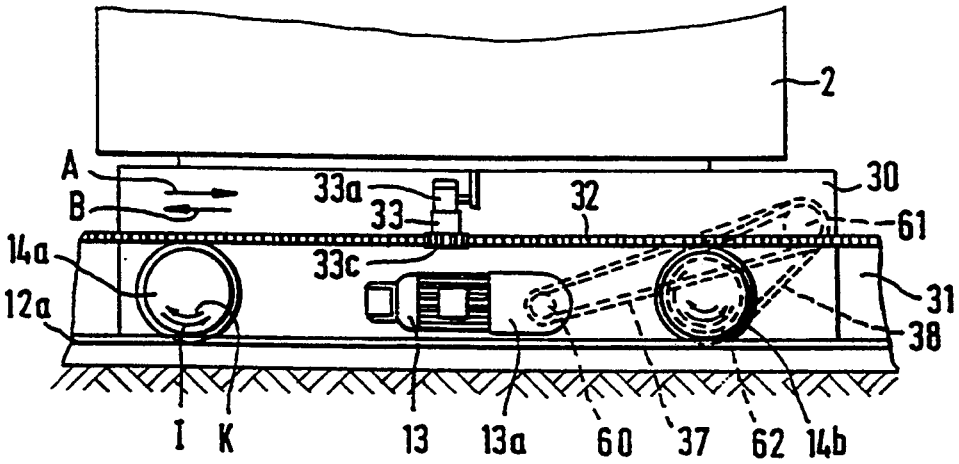
FIG. 1*b* is a schematic side elevational view, on an enlarged scale, of one part of the structure shown in FIG. 1, showing details of a preferred embodiment of the invention.

With particular reference to FIG. 3, the bale opener tower 2 is mounted on a carriage 30 which travels in the direction A, B and which has wheels 14, 15 running on the rails 12*a*, 12*b*. The wheels 14, 15 of the carriage 30 are driven by a propelling motor 13 mounted on the carriage chassis. As shown in FIG. 1*b*, the motor 13 is connected with a gearing 13*a* which, in turn, is coupled to the carriage wheels 14 by means of sprocket chains 37, 38 supported by sprockets 60, 61, and 62. The holding device 7 which supports the detaching device 4 is suspended by a cable 18*a* and end rolls 16 and 17 on a counterweight 18 and further, a lifting motor 19 is provided which, with the intermediary of transmission elements 20, 20*a* (for example, chains) and the end rolls 16*a*, 16*b* (for example, sprockets) effect a height adjustment of the detaching device 4. The displacement path y of the detaching device 4 in the vertical direction and the longitudinal (horizontal) displacement path E of the carriage 30 are coordinated by a control device 21 having control cables 22. Further, the bale opener tower 2 is rotatable relative to the carriage 30 about a vertical axis.

Turning to FIG. 1*b*, a toothed rack 32 is secured to the fixed suction duct 31 in an orientation parallel to the arrows A, B. To the carriage 30 parts of an incremental rotary displacement signalling device 33 are attached which, as illustrated in FIG. 1*d*, has a housing 33*a* and a shaft 33*b* which at one end penetrates through a capsulated housing wall and carries at its outer end a gear wheel 33*c*. The housing 33*a* screens interfering effects such as vibrations or jars from the sensor inside the housing to thus prevent an accidental change in setting. The shaft 33*b* extends into the housing 33*a* through a seal 33*d* whereby the shaft and the housing are hermetically separated from one another. In this manner dust, dirt or the like is prevented from entering the measuring device in the housing 33*a*. The sensor within the housing 33*a* is a device—conventional by itself—which emits a signal every time the shaft 33*b* turns through a predetermined angle. Thus, for example, to the shaft 33*b* a plastic disc 33*e* may be keyed which carries on its periphery four permanent magnets 33*f* (only two are visible) spaced 90° apart. A coil 33*g* is positioned stationarily at the disc 33*e*, and an electric pulse is generated in the coil 33*g* each time a magnet 33*f* passes by as the shaft 33*b* turns. Referring to FIG. 1*c*, the gear wheel 33*c* which is rotatable in the direction of the arrows G, H meshes with the toothed rack 32 so that upon travel of the carriage 30 in the direction A or B the gear wheel 33c rolls on the toothed rack 32 while remaining in a meshing relationship therewith. The toothed rack 32 constitutes a counter element forming part of the device 33.

Figure 2:
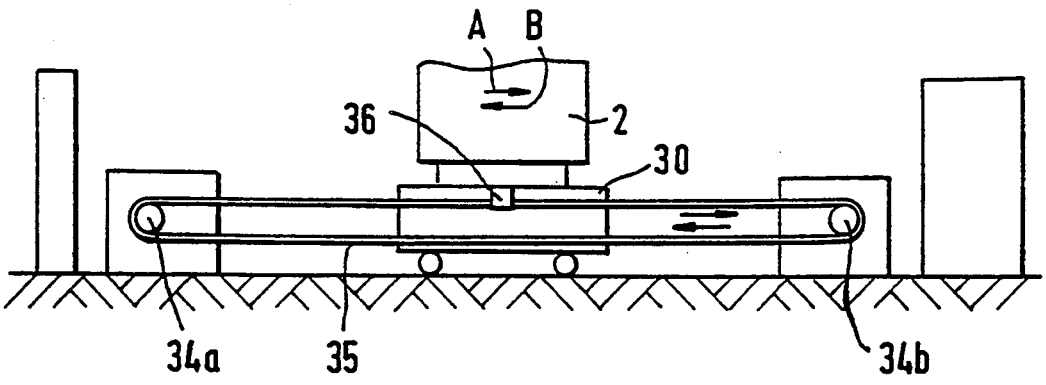
FIG. 2 is a schematic side elevational view of a further preferred embodiment of the invention.

Turning to FIG. 2, an endless sprocket belt 35 is supported by two end sprockets 34a and 34b. The sprocket belt 35 is affixed at one location to the carriage 30 by a securing element 36 and is thus pulled into circulating motion during and by the carriage travel. One of the belt sprockets, for example, the belt sprocket 34a functions as the toothed gear wheel 33c of FIG. 1d; thus, the belt sprocket 34a is mounted on a shaft 33b which penetrates into a housing 33a of the displacement signalling device 33. In the embodiment according to FIG. 2, the device 33 is thus stationarily mounted externally of the carriage 30 while the counter element (sprocket belt) 35 travels and accordingly rotates the sensor sprocket 34a.

Figure 4:
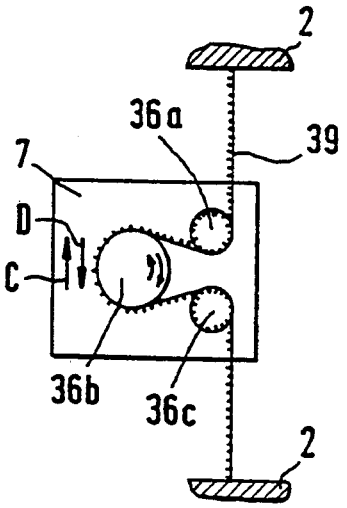
FIG. 4 is a schematic side elevational view of a further preferred embodiment of the invention including a travelling sprocket and a stationary sprocket belt.

Turning now to FIG. 4, the holding member 7 for the supporting the detaching device 4 (not shown in FIG. 4) carries three belt sprockets 36a, 36b and 36c about which there is trained a sprocket belt 39 having two opposite ends spaced vertically from one another and being affixed to the bale opener tower 2. In this embodiment the belt sprocket 36b constitutes the rotary toothed element and thus replaces the toothed wheel 33c of the construction shown in FIG. 1d.

Figure 5:
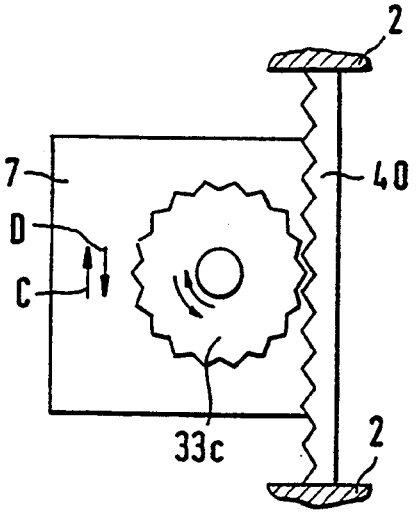
FIG. 5 is a schematic side elevational view of a further preferred embodiment of the invention including a travelling gear in engagement with a toothed rack.

According to FIG. 5, a toothed gear wheel 33c is rotatably mounted on the holding device 7 for a meshing engagement with the vertically oriented toothed rack 40 affixed to the bale opener tower 2.

The device according to the invention is particularly of significance if used during an inclined detaching of the fiber tufts because in such an operation a determination of the exact location of the detaching device 4 along its horizontal path of travel as well as its exact vertical location relative to the bale opener tower 2 is of importance.

An arrangement of the displacement signalling device 33 on the carriage 30 and/or the bale opener tower 2 is advantageous as compared to an arrangement on the wheels 14 and 15, or at the drive 13a or the propelling motor 13 for determining the position along the horizontal travel (x-axis). This is so, because of the significant moving masses of the bale opener 1 a slippage of the wheels 14 and 15 during braking of the bale opener may occur, that is, while the carriage 30 continues to move, the carriage wheels 14, 15 may be locked. As a result, the displacement signalling device which should indicate displacement of the carriage does not do so under these conditions. Further, the chains 37, 38 as well as the gearing 13a have usually a certain play which may result in measuring errors. Thus, it is an advantage of arranging the displacement signalling device 33 on the chassis of the carriage 30 that even if the wheels 14 and 15 slide on the rails without rotating, the location of the bale opener along its path continues to be accurately sensed.

Thus, the rotary toothed element, for example, the toothed wheel 33c, the sprocket belt 34 and the sprocket 16 have teeth defining tooth gaps therebetween. The counter element has gaps into which the teeth of the toothed element engage. The counter element may be the toothed rack 32 or the sprocket belt 35 which is provided with teeth as well. The chain 20a as counter element, on the other hand, has no teeth; it is provided with spaced gaps into which the teeth of the rotary toothed element extend.

For determining the height position (y-axis) of the detaching device 4, the embodiment according to FIG. 3 is advantageous when the displacement signalling device 33 is stationary and is associated with the end roll 16. In case of an inclined fiber tuft removing operation, the detaching device 4 repeatedly and automatically travels to the highest position, that is, to a dead center position. During such an operation a likely play appears between the sprocket chain 20a and the chain sprockets 16a and 16b which in the embodiment according to FIG. 3 has no interfering effect.

In the embodiments shown in FIGS. 6, 7, 8, 10 and 11 displacement signalling devices are shown in which a travelling member and a stationary member cooperate without contacting one another to generate signals utilized for determining the x-position (longitudinal position) and y-position (vertical position) of the detaching device 4.

Figure 6:
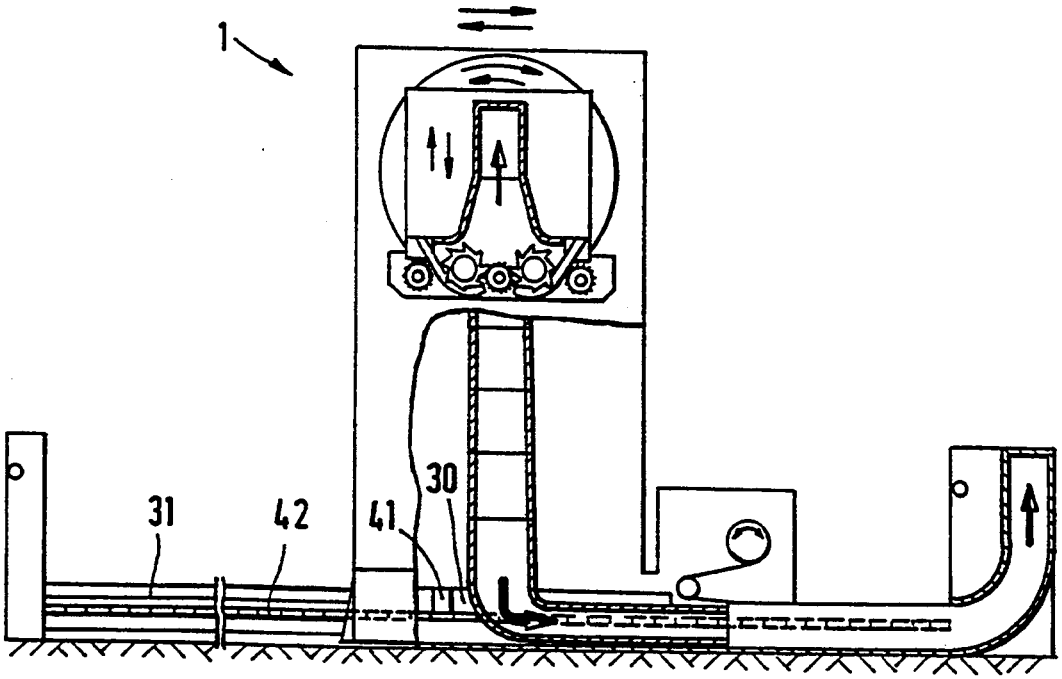
FIG. 6 is a schematic, partially sectional side elevational view of a bale opener incorporating still another preferred embodiment of the invention.

Thus, in FIG. 6, a magnet 41 is used as a position signalling element, and a plurality of induction coils 42 are provided as an absolute position-determining assembly. The induction coils 42 are secured in a series parallel to the direction of bale opener travel. Thus, the magnet 41 is secured to the carriage 30 while the induction coils 42 are secured to the suction duct 31. As the carriage 30 travels, the magnet 41 secured thereto sequentially induces current in the consecutive coils 42. Such a measuring system works in an absolute fashion, that is, without reference magnitude. The end-to-end arranged induction coils 42 are secured to a bar; there may be present a plurality of such bars to provide the continuous series of induction coils along the travelling path of the bale opener.

Figure 7:
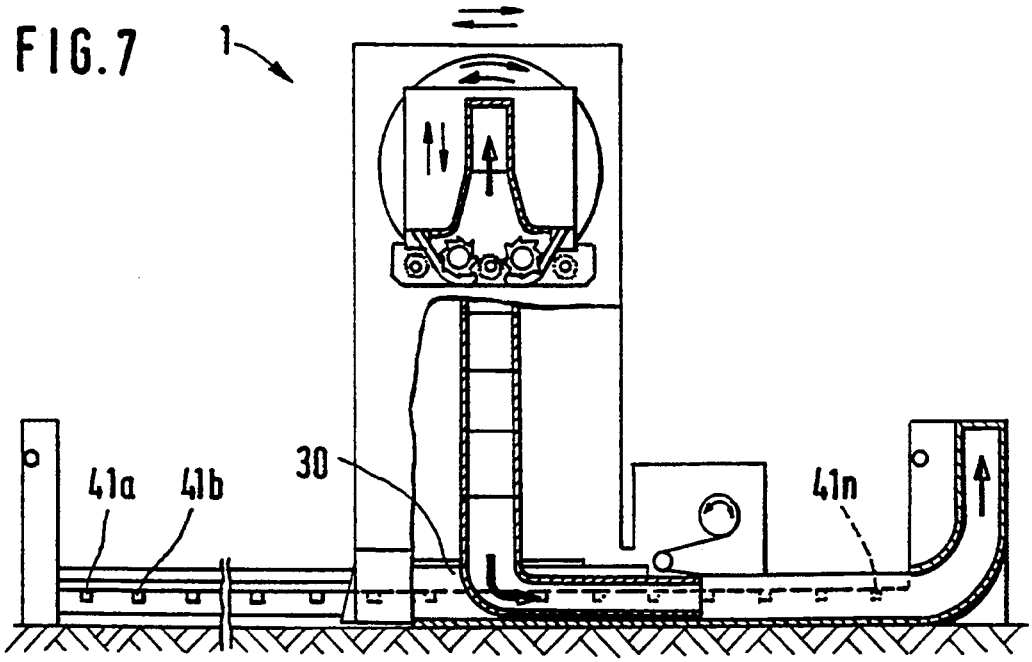
FIG. 7 is a schematic, partially sectional side elevational view of a bale opener incorporating yet another preferred embodiment of the invention.

Turning to the embodiment shown in FIG. 7, there are provided a series of magnets 41a, 41b . . . 41n arranged in a series along the travelling path of the bale opener. The inductive coils 42 are movable components: they are secured to the travelling carriage 30. In this embodiment a single bar with several induction coils 42 thereon is used.

Figure 8:
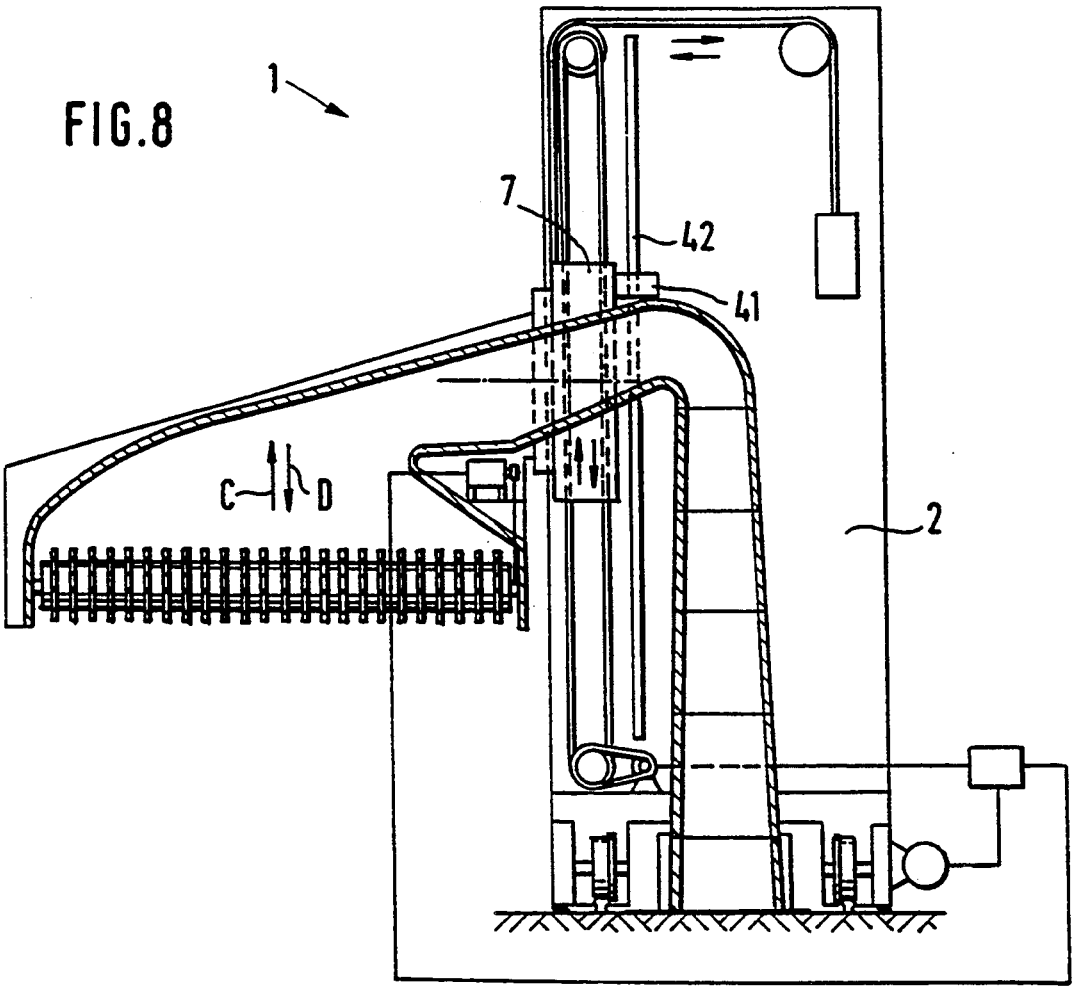
FIG. 8 is a schematic, partially sectional end elevational view of a bale opener incorporating a further preferred embodiment of the invention.

According to FIG. 8, a magnet 41 is secured to the vertically movable holding device 7 whereas inductive coils 42 are arranged in a vertical series stationarily on the bale opener tower 2.

Figure 9:
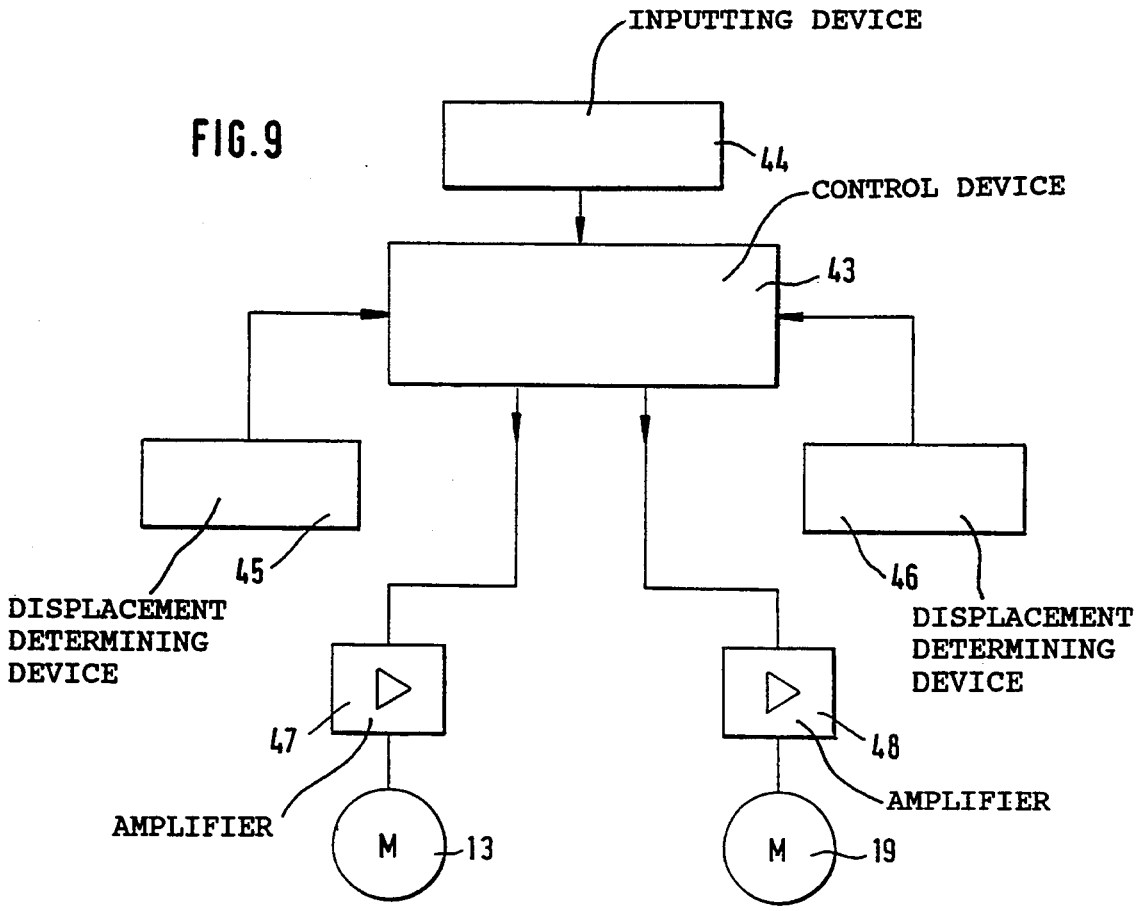
FIG. 9 is a block diagram for controlling the apparatus according to the invention.

Turning to FIG. 9, there is shown a block diagram representing a control device 43 for a computer controlled, programmed operation of the fiber tuft detaching operation. The control device 43 is connected with an inputting device 44 and further, with the control device 43 there is connected a displacement determining device 45, for example, an arrangement as described in connection with FIG. 1d where a signal is emitted after a predetermined angular turn of the toothed wheel 33c, so that from such signals the length of travel of the gear wheel 33c on the meshing toothed rack 32 and thus the displacement of the detaching device 4 and its location along its travelling path may be determined. Such displacement and location determining device may be arranged on the carriage 30 for the horizontal displacement (x-axis) and at the support roll 16 at the holding device 7 for a vertical displacement and position of the detaching device 4 (y-axis). Further, the control device 43 is connected with the intermediary of an amplifier 47 (such as a frequency converter) with the propelling motor 13 and, with the intermediary of an amplifier 48, with the lifting motor 19.

Figure 10:
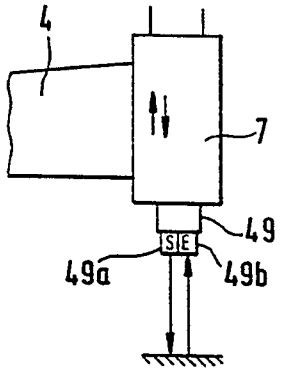
FIG. 10 is a schematic side elevational view of still a further preferred embodiment of the invention.

Turning now to FIG. 10, for determining the height position according to the invention (y-axis), an optical barrier 49 having transmitters 49*a* and receivers 49*b* is mounted on the holding device 7. By means of a light beam emitted by the transmitter 49*a* and reflected from a predetermined fixed component of, for example, the bale opener tower, the height position of the holding device 7 and thus the detaching device 4 may be determined. It is to be understood that as an alternative, the optical device 49 may be mounted on the underside of the housing of the detaching device 4.

Figure 11:
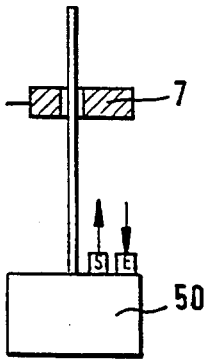
FIG. 11 is an elevational view, partially in section, of yet another preferred embodiment of the invention.

Turning to FIG. 11, for determining the height position of the holding device 7 and thus the detaching device 4, an ultrasound generator 50 is mounted, for example, on the bale opener tower 2 for reflecting sound from a predetermined component of the holding device 7 and receiving such sound in a detector to thus determine the height position of the holding device 7. It is to be understood that in FIG. 10, the optical device may be secured fixedly to the bale opener tower and as to the embodiment shown in FIG. 11, the ultrasound generator may be carried by the holding device 7 or the detaching device 4.

It will be understood that the above description of the present invention is susceptible to various modifications, changes and adaptations, and the same are intended to be comprehended within the meaning and range of equivalents of the appended claims.

What is claimed is:

1. A bale opener for removing fiber tufts from top surfaces of fiber bales assembled in a series, comprising (a) a carriage for travelling back-and-forth along a generally horizontal, first path of travel along the fiber bale series;

(b) a tower mounted on the carriage for travel therewith;

(c) a detaching device extending from the tower; the detaching device having a detaching element for penetrating into the bale surfaces to remove fiber tufts therefrom during travel of the tower; said carriage, said tower and said detaching device forming components of a travelling assembly;

(d) holding means for vertically displaceably mounting said detaching device in said tower, whereby said detaching device is movable relative to the tower along a generally vertical, second path of travel; and (e) a position determining device for determining the location of said detaching device along at least one of said first and second paths of travel; said position determining device including (1) a first element forming a position transmitter and being mounted on a component of said travelling assembly; and (2) a second element forming an absolute position indicator and being stationarily mounted along one of said first and second paths of travel for generating signals in said second component as a function of displacement of said detaching device along at least one of said first and second paths of travel; said first and second paths of travel; said first and second elements cooperating without contacting one another.

2. The bale opener as defined in claim 1, wherein said first element is a permanent magnet.

3. The bale opener as defined in claim 2, wherein said second element comprises a plurality of coils arranged in a series along said one path of travel.

4. The bale opener as defined in claim 1, wherein said first element is mounted on one of said holding means and said detaching device and said second element is mounted on said tower along said vertical, second path of travel, whereby said first element generates signals in said second element during a vertical displacement of said detaching device.

5. The bale opener as defined in claim 4, wherein said first element comprises a magnet and said second element comprises a plurality of inductive coils stationarily arranged in a vertical series on the bale opener tower.

* * * * *